US010424257B2

(12) United States Patent
Zha

(10) Patent No.: US 10,424,257 B2
(45) Date of Patent: Sep. 24, 2019

(54) BACKLIGHT DRIVING METHOD AND BACKLIGHT DRIVING DEVICE

(71) Applicant: Wuhan China Star Optoelectronics Technology Co., Ltd., Wuhan, Hubei (CN)

(72) Inventor: Guowei Zha, Guangdong (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 0 days.

(21) Appl. No.: 15/740,542

(22) PCT Filed: Nov. 24, 2017

(86) PCT No.: PCT/CN2017/112936

§ 371 (c)(1),
(2) Date: Dec. 28, 2017

(87) PCT Pub. No.: WO2019/095425

PCT Pub. Date: May 23, 2019

(65) Prior Publication Data

US 2019/0147804 A1 May 16, 2019

(30) Foreign Application Priority Data

Nov. 14, 2017 (CN) ..... 2017 1 1121717

(51) Int. Cl.
*G09G 3/34* (2006.01)

(52) U.S. Cl.
CPC ... *G09G 3/3406* (2013.01); *G09G 2320/0247* (2013.01); *G09G 2320/062* (2013.01); *G09G 2320/064* (2013.01)

(58) Field of Classification Search
CPC .... G09G 3/3406; G09G 3/3413; G09G 3/342; G09G 3/3426; G09G 5/02; G09G 5/10;
(Continued)

(56) References Cited

U.S. PATENT DOCUMENTS

2011/0249039 A1* 10/2011 Ogi ..... G09G 3/3426 345/690
2012/0075353 A1* 3/2012 Dong ..... H04N 5/58 345/690

(Continued)

FOREIGN PATENT DOCUMENTS

CN 101727876 A 6/2010
CN 102243855 A 11/2011
CN 105654909 A 6/2016

OTHER PUBLICATIONS

Office Action dated Feb. 3, 2019 from corresponding application No. CN 201711121717.1.

*Primary Examiner* — Darlene M Ritchie
(74) *Attorney, Agent, or Firm* — Hauptman Ham, LLP

(57) ABSTRACT

Disclosed is a backlight driving method. The backlight driving method includes: obtaining a first backlight brightness eigenvalue of one block of the frame; obtaining a backlight brightness eigenvalue of one block of each of M adjacent frames; calculating an absolute value of a difference between the first backlight brightness eigenvalue and a second backlight brightness eigenvalue of one block of a previous frame; determining a time-averaged length according to the absolute value; calculating a third backlight brightness eigenvalue of the one block of the frame according to the first backlight brightness eigenvalue and a backlight brightness eigenvalue of one block of each of the T adjacent frames; and driving the backlight corresponding to the one block of the frame according to the third backlight brightness eigenvalue.

2 Claims, 5 Drawing Sheets

(58) Field of Classification Search
CPC ..... G09G 2320/064; G09G 2320/0247; G09G 2320/0233; G09G 2320/0242; G09G 2320/062; G09G 2320/0626; G09G 2320/0633; G09G 2320/0646
See application file for complete search history.

(56) References Cited

U.S. PATENT DOCUMENTS

2012/0327303 A1* 12/2012 Sun ..... G09G 3/3406 348/687
2013/0169663 A1* 7/2013 Seong ..... G09G 5/00 345/589
2014/0225935 A1* 8/2014 Lee ..... G09G 3/3426 345/690

* cited by examiner

BACKLIGHT DRIVING METHOD AND BACKLIGHT DRIVING DEVICE

RELATED APPLICATIONS

The present application is a National Phase of International Application Number PCT/CN2017/112936, filed on Nov. 24, 2017, and claims the priority of China Application No. 201711121717.1, filed on Nov. 14, 2017.

FIELD OF THE DISCLOSURE

The disclosure relates to a liquid crystal display filed, and more particularly to a backlight driving method and a backlight driving device.

BACKGROUND

The achievement of the display technology is to rebuild a visual sensation to the world for human eyes. Nowadays, the display technologies mainly include the Liquid Crystal Display (LCD) and the Organic Light-Emitting Diode (OLED). The development of OLED is later than the development of LCD, and OLED has a higher cost and restricted life-time. However, the dark state of LED is not good enough, so that the contrast ratio of LCD is worse that the contrast ratio of OLED due to the self-emissive characteristic of OLED. To overcome the disadvantages of LCD, dynamical backlight adjustment for divided frame is often used. To implement the dynamical backlight adjustment, relevant hardware and dynamical control algorithm are essential. Good algorithms can make the backlight control match with images possible.

For the dynamical backlight adjustment for whole frame or divided frame, the backlight control is relevant to the statistic of the gray scale of one block or one frame. Usually, the backlight brightness of one block or one frame is determined by the maximum gray scale, the average gray scale or other reference gray scales. Thus, ideally, the backlight brightness varies with time. When there are noises, the backlight brightness will vary too frequently such that flickers seen by human eyes occur.

SUMMARY

The backlight driving method, the backlight driving device and other relevant products provided by the present disclosure can reduce the brightness variation between adjacent frames and can filter flickers caused by the brightness variation when there are noises.

The backlight driving method provided by the present disclosure includes: dividing one frame into N blocks, wherein N is a positive integer, obtaining a first backlight brightness eigenvalue of one block of the frame, and obtaining a backlight brightness eigenvalue of one block of each of M adjacent frames, wherein M is an integer larger than 1; calculating an absolute value of a difference between the first backlight brightness eigenvalue and a second backlight brightness eigenvalue of one block of a previous frame; determining a time-averaged length according to the absolute value, wherein the time-averaged length corresponds to T adjacent frames and T is an integer larger than 1; calculating a third backlight brightness eigenvalue of the one block of the frame according to the first backlight brightness eigenvalue and a backlight brightness eigenvalue of one block of each of the T adjacent frames; and driving the backlight corresponding to the one block of the frame according to the third backlight brightness eigenvalue.

The backlight driving device provided by the present disclosure includes a division module, a capturing module, a first calculation module, a determination module, a second calculation module and a backlight driving module. The division module divides one frame into N blocks, wherein N is a positive integer. The capturing module obtains a first backlight brightness eigenvalue of one block of the frame, and obtains a backlight brightness eigenvalue of one block of each of M adjacent frames, wherein M is an integer larger than 1. The first calculation module calculates an absolute value of a difference between the first backlight brightness eigenvalue and a second backlight brightness eigenvalue of one block of a previous frame. The determination module determines a time-averaged length according to the absolute value. The time-averaged length corresponds to T adjacent frames and T is an integer larger than 1. The second calculation module calculates a third backlight brightness eigenvalue of the one block of the frame according to the first backlight brightness eigenvalue and a backlight brightness eigenvalue of one block of each of the T adjacent frames. The backlight driving module drives the backlight corresponding to the one block of the frame according to the third backlight brightness eigenvalue.

The display device provided by the present disclosure includes at least one processor, at least one storage device, at least one communication port and one or more programs. The one or more programs are stored in the storage device and executed by one or more processors. The backlight driving method described above is implemented by the one or more programs.

The computer readable medium provided by the present disclosure stores a computer program for data exchanging. A computer executes the computer program for implementing the backlight driving method described above.

The computer program product provided by the present disclosure includes a non-transitory computer readable storage medium storing a computer program. A computer executes the computer program for implementing the backlight driving method described above.

According to the above, after executing the steps including: dividing one frame into N blocks, wherein N is a positive integer; obtaining a first backlight brightness eigenvalue of one block of the frame, and obtaining a backlight brightness eigenvalue of one block of each of M adjacent frames, wherein M is an integer larger than 1; and calculating an absolute value of a difference between the first backlight brightness eigenvalue and a second backlight brightness eigenvalue of one block of a previous frame, the backlight brightness variation of the frame and its previous frame and whether there are noises can be determined according to the absolute value. For example, when the absolute value is not smaller than the backlight brightness variation threshold, it can be determined that the backlight brightness variation between the frame and its previous frame is dramatic. On the other hand, when the absolute value is smaller than the backlight brightness variation threshold, it can be determined that the backlight brightness variation between the frame and its previous frame is less. The time-averaged length T is determined according to the absolute value, and the time-averaged length T corresponds to T frames adjacent to the frame. The third backlight brightness eigenvalue is calculated according to the first backlight brightness eigenvalue and T backlight brightness eigenvalues of the T frames. The backlight of one block of the frame is driven according to the third backlight brightness eigenvalue. As a result, when the brightness of the backlight dramatically varies from one frame to the next frame, the brightness of the backlight can be quickly adjusted with the frames, and when the brightness of the backlight slightly varies from one frame to the next frame, the flickers caused by the brightness variation can be filtered.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

Figure 1:
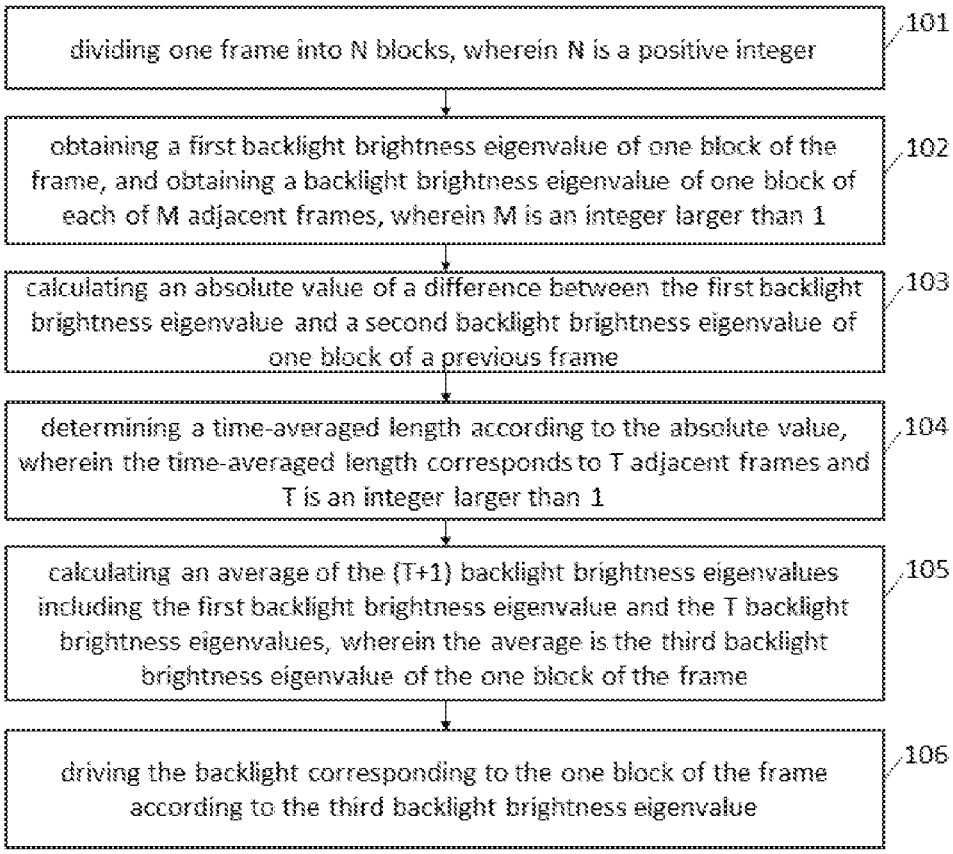
FIG. 1 is a flow chart of a backlight driving method according to one embodiment of the disclosure.

The specific structural and functional details disclosed herein are only representative and are intended for describing exemplary embodiments of the disclosure. However, the disclosure can be embodied in many forms of substitution, and should not be interpreted as merely limited to the embodiments described herein.

In the description of the disclosure, terms such as "center", "transverse", "above", "below", "left", "right", "vertical", "horizontal", "top", "bottom", "inside", "outside", etc. for indicating orientations or positional relationships refer to orientations or positional relationships as shown in the drawings; the terms are for the purpose of illustrating the disclosure and simplifying the description rather than indicating or implying the device or element must have a certain orientation and be structured or operated by the certain orientation, and therefore cannot be regarded as limitation with respect to the disclosure. Moreover, terms such as "first" and "second" are merely for the purpose of illustration and cannot be understood as indicating or implying the relative importance or implicitly indicating the number of the technical feature. Therefore, features defined by "first" and "second" can explicitly or implicitly include one or more the features. In the description of the disclosure, unless otherwise indicated, the meaning of "plural" is two or more than two. In addition, the term "comprise" and any variations thereof are meant to cover a non-exclusive inclusion.

Any reference in this specification to an "embodiment" means that a particular feature, structure, or characteristic described in connection with the embodiment is included in at least one embodiment. The appearances of such phrases are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

To overcome the disadvantages of LCD, dynamical backlight adjustment for divided frame is often used to adjust the backlight brightness of each divided frame according to the image currently displayed. For the dynamical backlight adjustment for whole frame or divided frame, the backlight control is relevant to the statistic of the gray scale of one block or one frame. Usually, the backlight brightness of one block or one frame is determined by the maximum gray scale, the average gray scale or other reference gray scales. Thus, ideally, the backlight brightness varies with time. When there are noises, the backlight brightness will vary too frequently such that flickers seen by human eyes occur.

The display device in the present disclosure includes a LCD panel, and the LCD panel uses LEDs as the backlight source or uses the Cold Cathode Fluorescent Lamp (CCFL) as the backlight source.

Referring to FIG. 1, a flow chart of a backlight driving method according to one embodiment of the disclosure is shown. As shown in FIG. 1, the backlight driving method provided in this embodiment includes steps as follows.

Step 101: dividing one frame into N blocks, wherein N is a positive integer. Then, an arbitrary block is processed by executing Step 102~Step 106.

In this embodiment, any frame of an image can be divided into multiple blocks. The backlight brightness of one block can be adjusted according to a backlight brightness eigenvalue corresponding to the block.

The display device can have multiple blocks. When the display device displays one frame of an image, the frame can be divided into blocks corresponding to the blocks of the display device.

Step 102: obtaining a first backlight brightness eigenvalue of one block of the frame, and obtaining a backlight brightness eigenvalue of one block of each of M adjacent frames, wherein M is an integer larger than 1.

In this embodiment, the step "obtaining a first backlight brightness eigenvalue of one block of the frame" and the step "obtaining a backlight brightness eigenvalue of one block of each of M adjacent frames" may have any sequence of occurrence.

How to obtain a backlight brightness eigenvalue of one block of each of M adjacent frames is similar to obtain a first backlight brightness eigenvalue of one block of the frame.

The M adjacent frames of the frame can be M adjacent frames before the frame or M adjacent frames after the frame, or the M adjacent frames of the frame can be M1 frames before the frame and M2 frames after the frame, wherein the M=M1+M2 and M1 and M2 are both positive integers.

In step 102, the step "obtaining a first backlight brightness eigenvalue of one block of the frame" includes steps as follows.

Step 21: obtaining a fourth backlight brightness eigenvalue of the one block of the frame.

Step 22: spatially filtering the one block of the frame to obtain the first backlight brightness eigenvalue according to the fourth backlight brightness eigenvalue.

The backlight of the one block may diffuse to adjacent blocks, and the backlight of the adjacent blocks may also diffuse to the one block, which causes crosstalk. The crosstalk can be cancelled by using a spatial filter to spatially filter the first block of the first frame. The spatial filtering algorithm can be, for example, the Gaussian Filtering Algorithm. Due to a spatial filtering process, the backlight brightness eigenvalue of the frame of the image will vary from the fourth backlight brightness eigenvalue to the first backlight brightness eigenvalue.

In Step 21, the step "obtaining a fourth backlight brightness eigenvalue of the one block of the frame" includes steps as follows.

Step A1: calculating a maximum gray-scale value of each of P pixels in the one block of the frame to obtain P gray-scale eigenvalues, wherein each maximum gray-scale value is one gray-scale eigenvalue and P is an integer larger than 1.

Step A2: generating a statistical distribution table according to the P gray-scale eigenvalues.

Step A3: choosing a target gray-scale eigenvalue among the gray-scale eigenvalues as the fourth backlight brightness eigenvalue, wherein the number of the chosen gray-scale eigenvalue is larger than a predetermined number.

A pixel of one frame of the image includes a red sub-pixel (Red, R), a green sub-pixel (Green, G) and a blue sub-pixel (Blue, B), and thus the gray scale of any pixel can be represented by (R, G, B).

For one pixel of a block, the maximum gray-scale value can be the maximum of the gray scales (R, G, B) of the one pixel in several historical frames. Besides, the maximum gray-scale value is considered a gray-scale eigenvalue of the pixel.

The predetermined number can be set by a user or predetermined by the system.

A statistical distribution table can be generated by doing a statistics for the P gray-scale eigenvalues. In the statistical distribution table, the P gray-scale eigenvalues can be arranged from the maximum to the minimum, and the number of each gray-scale eigenvalue can be counted and recorded. Thus, according to the statistical distribution table, the first one of the gray-scale eigenvalues of which the numbers are larger than the predetermined number is considered the fourth backlight brightness eigenvalue. For example, the statistical distribution table is as below.

| gray-scale eigenvalue | 255 | 254 | 253 | 252 | 251 | 250 | . . . | 2 | 1 | 0 |
|---|---|---|---|---|---|---|---|---|---|---|
| number | 14 | 15 | 16 | 1 | 20 | 2 | . . . | 60 | 60 | 200 |

Assumed that the predetermined number is 19. The number of the gray-scale eigenvalue 251 is 20, so the gray-scale eigenvalue 251 is the first one of the gray-scale eigenvalues of which the numbers are larger than 19. Thus, the fourth backlight brightness eigenvalue of the first block of the first frame is determined as 251.

Step 103: calculating an absolute value of a difference between the first backlight brightness eigenvalue and a second backlight brightness eigenvalue of one block of a previous frame.

It can be understood that the previous frame of the frame should be included in the M adjacent frames of the frame, and that the M backlight brightness eigenvalues include the second backlight brightness eigenvalue.

Step 104: determining a time-averaged length according to the absolute value, wherein the time-averaged length corresponds to T adjacent frames and T is an integer larger than 1.

The backlight brightness variation threshold can be predetermined. A comparison result can be obtained by comparing the above absolute value and the backlight brightness variation threshold. According to the comparison result, the backlight brightness variation between the frame and its previous frame can be known, or whether there are noises can be known. After that, the time-averaged length T can be accordingly determined.

To calculate the third backlight brightness eigenvalue of the one block of the frame, an average of the backlight brightness eigenvalues of the frame and the adjacent frames is calculated. The time-averaged length corresponds to T frames adjacent to the frame and represents for the number of the adjacent frames.

In step 104, the step "determining a time-averaged length according to the absolute value" includes steps as follows.

Step 41: comparing the absolute value and a predetermined backlight brightness variation threshold.

Step 42: determining the time-averaged length as a predetermined frame length when the absolute value is smaller than the predetermined backlight brightness variation threshold, but determining the time-averaged length as 0 when the absolute value is larger than or equal to the predetermined backlight brightness variation threshold, wherein 0<the predetermined frame length≤M.

After comparing the absolute value and the predetermined backlight brightness variation threshold, one of three comparison results can be obtained. The three comparison results include that the absolute value is larger than the predetermined backlight brightness variation threshold, that the absolute value is equal to the predetermined backlight brightness variation threshold, and that the absolute value is smaller than the predetermined backlight brightness variation threshold.

When the absolute value is larger than or equal to the predetermined backlight brightness variation threshold, it can be known that the backlight brightness variation between the frame and its previous frame is dramatic, and thus the time-averaged length T is determined as 0. On the other hand, when the absolute value is smaller than the predetermined backlight brightness variation threshold, it can be known that the backlight brightness variation between the frame and its previous frame is less or there are noises, and thus the time-averaged length T is determined as the predetermined frame length T0.

The backlight brightness variation threshold can be set by a user or predetermined by the system. The backlight brightness variation threshold is not smaller than 0. For example, the backlight brightness variation threshold can be 5.

The frame frequency of a general display device is 60 Hz, which means 60 frames are refreshed per second. The above described frame length includes the number of frames chosen for calculating the third backlight brightness eigenvalue when considering the backlight brightness variation among the adjacent frames. The predetermined frame length T0 can be set by a user or predetermined by the system. For example, the predetermined frame length T0 can be 5.

Step 105: calculating a third backlight brightness eigenvalue of the one block of the frame according to the first backlight brightness eigenvalue and a backlight brightness eigenvalue of one block of each of the T adjacent frames.

The T frames adjacent to the frame are included in the above mentioned M frames. Thus, it can be understood that, the M backlight brightness eigenvalues include the T backlight brightness eigenvalues of an arbitrary block of the T frames.

The step 105 includes: calculating an average of the (T+1) backlight brightness eigenvalues including the first backlight brightness eigenvalue and the T backlight brightness eigenvalues, wherein the average is the third backlight brightness eigenvalue of the one block of the frame.

The equation for calculating an average of the (T+1) backlight brightness eigenvalues including the first backlight brightness eigenvalue and the T backlight brightness eigenvalues can be represented by the following equation.

$$F = \sum_{i-1}^{t} Blu/(T+1)$$

In this equation, "F" is the average of the (T+1) backlight brightness eigenvalues including the first backlight brightness eigenvalue and the T backlight brightness eigenvalues, "t" is the time of the frame and corresponds to the first frame, "[t−T, t]" is the time interval between the frame and its previous frame and corresponds to "from the previous frame to the frame", and "Blu" includes the second backlight brightness eigenvalue and (T+1) backlight brightness eigenvalues including the T backlight brightness eigenvalues.

When the absolute value is not smaller than the backlight brightness variation threshold, it can be known that the backlight brightness variation between the frame and its previous frame is dramatic, and thus the time-averaged length T is determined as 0. In other words, the third backlight brightness eigenvalue of the one block of the frame is determined as the second backlight brightness eigenvalue such that the backlight of the one block can adapted to the backlight brightness variation. When the absolute value is smaller than the backlight brightness variation threshold, it can be known that the backlight brightness variation between the frame and its previous frame is less, and thus the time-averaged length T is determined as the predetermined frame length T0. For example, the predetermined frame length T0 is 5, so the time-averaged length T is 5. In this case, the third backlight brightness eigenvalue of the one block of the frame is determined to include an average of six backlight brightness eigenvalues including the second backlight brightness eigenvalue and five backlight brightness eigenvalue of the five frames before the frame, such that flickers can be avoided.

Step 106: driving the backlight corresponding to the one block of the frame according to the third backlight brightness eigenvalue.

In step 106, the third backlight brightness eigenvalue is converted to a backlight adjusting signal, and the backlight of the one block of the frame is adjusted according to the backlight adjusting signal.

According to the above, after executing the steps including: dividing one frame into N blocks, wherein N is a positive integer; obtaining a first backlight brightness eigenvalue of one block of the frame, and obtaining a backlight brightness eigenvalue of one block of each of M adjacent frames, wherein M is an integer larger than 1; and calculating an absolute value of a difference between the first backlight brightness eigenvalue and a second backlight brightness eigenvalue of one block of a previous frame, the backlight brightness variation of the frame and its previous frame and whether there are noises can be determined according to the absolute value. For example, when the absolute value is not smaller than the backlight brightness variation threshold, it can be determined that the backlight brightness variation between the frame and its previous frame is dramatic. On the other hand, when the absolute value is smaller than the backlight brightness variation threshold, it can be determined that the backlight brightness variation between the frame and its previous frame is less. The time-averaged length T is determined according to the absolute value, and the time-averaged length T corresponds to T frames adjacent to the frame. The third backlight brightness eigenvalue is calculated according to the first backlight brightness eigenvalue and T backlight brightness eigenvalues of the T frames. The backlight of one block of the frame is driven according to the third backlight brightness eigenvalue. As a result, when the brightness of the backlight dramatically varies from one frame to the next frame, the brightness of the backlight can be quickly adjusted with the frames, and when the brightness of the backlight slightly varies from one frame to the next frame, the flickers caused by the brightness variation can be filtered.

Figure 2:
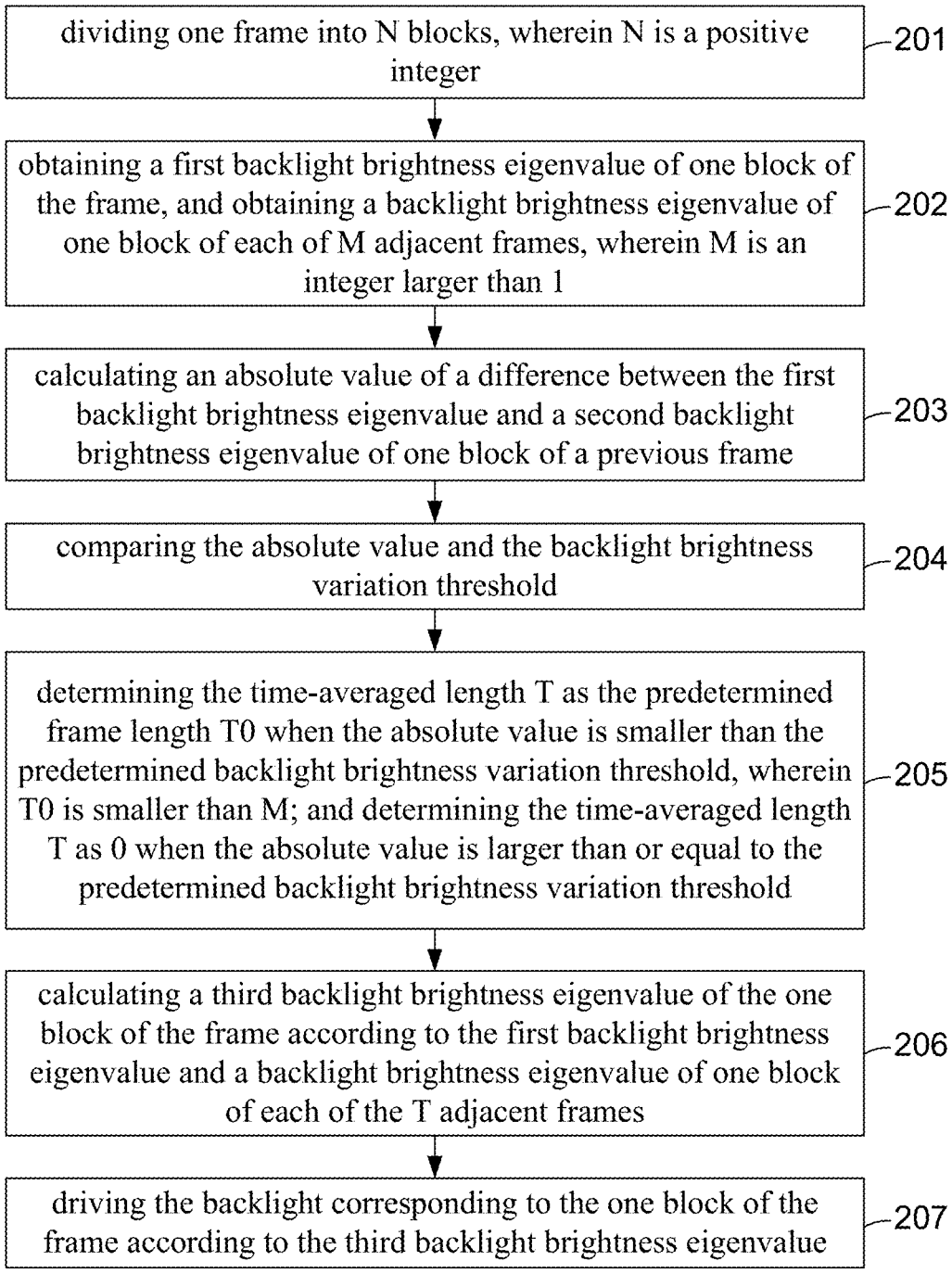
FIG. 2 is a flow chart of a backlight driving method according to another embodiment of the disclosure.

Referring to FIG. 2, a flow chart of a backlight driving method according to another embodiment of the disclosure is shown. As shown in FIG. 2, the backlight driving method provided in this embodiment includes steps as follows.

Step 201: dividing one frame into N blocks, wherein N is a positive integer. Then, an arbitrary block is processed by executing Step 202~Step 207.

Step 202: obtaining a first backlight brightness eigenvalue of one block of the frame, and obtaining a backlight brightness eigenvalue of one block of each of M adjacent frames, wherein M is an integer larger than 1.

Step S203: calculating an absolute value of a difference between the first backlight brightness eigenvalue and a second backlight brightness eigenvalue of one block of a previous frame.

Whether the backlight brightness variation between one frame and its previous frame is dramatic or less can be determined according to the absolute value.

Step 204: comparing the absolute value and the backlight brightness variation threshold.

After comparing the absolute value and the predetermined backlight brightness variation threshold, one of three comparison results can be obtained. The three comparison results include that the absolute value is larger than the predetermined backlight brightness variation threshold, that the absolute value is equal to the predetermined backlight brightness variation threshold, and that the absolute value is smaller than the predetermined backlight brightness variation threshold. When the absolute value is not smaller than the predetermined backlight brightness variation threshold, it can be known that the backlight brightness variation between the frame and its previous frame is dramatic. On the other hand, when the absolute value is smaller than the predetermined backlight brightness variation threshold, it can be known that the backlight brightness variation between the frame and its previous frame is less.

Step 205: determining the time-averaged length T as the predetermined frame length T0 when the absolute value is smaller than the predetermined backlight brightness variation threshold, wherein T0 is smaller than M; and determining the time-averaged length T as 0 when the absolute value is larger than or equal to the predetermined backlight brightness variation threshold.

When the absolute value is larger than or equal to the predetermined backlight brightness variation threshold, it can be known that the backlight brightness variation between the frame and its previous frame is dramatic. In this case, the time-averaged length T can be determined as 0. On the other hand, when the absolute value is smaller than the predetermined backlight brightness variation threshold, it can be known that the backlight brightness variation between the frame and its previous frame is less or there are noises. In this case, the time-averaged length T can be determined as the predetermined frame length T0.

Step 206: calculating a third backlight brightness eigenvalue of the one block of the frame according to the first backlight brightness eigenvalue and a backlight brightness eigenvalue of one block of each of the T adjacent frames.

The T frames adjacent to the frame are included in the above mentioned M frames. Thus, it can be understood that, the M backlight brightness eigenvalues include the T backlight brightness eigenvalues of an arbitrary block of the T frames.

The step 206 includes: calculating an average of the (T+1) backlight brightness eigenvalues including the first backlight brightness eigenvalue and the T backlight brightness eigenvalues, wherein the average is the third backlight brightness eigenvalue of the one block of the frame.

The equation for calculating an average of the (T+1) backlight brightness eigenvalues including the first backlight brightness eigenvalue and the T backlight brightness eigenvalues can be represented by the following equation.

$$F = \sum_{t}^{t+T} Blu/(T+1)$$

In this equation, "F" is the average of the (T+1) backlight brightness eigenvalues including the first backlight brightness eigenvalue and the T backlight brightness eigenvalues, "t" is the time of the frame and corresponds to the first frame, "[t, t+T]" is the time interval between the frame and its previous frame and corresponds to "from the previous frame to the frame", and "Blu" includes the second backlight brightness eigenvalue and (T+1) backlight brightness eigenvalues including the T backlight brightness eigenvalues.

Step 207: driving the backlight corresponding to the one block of the frame according to the third backlight brightness eigenvalue.

In step 207, the third backlight brightness eigenvalue is converted to a backlight adjusting signal, and the backlight of the one block of the frame is adjusted according to the backlight adjusting signal.

According to the above, after executing the steps including: dividing one frame into N blocks, wherein N is a positive integer; obtaining a first backlight brightness eigenvalue of one block of the frame, and obtaining a backlight brightness eigenvalue of one block of each of M adjacent frames, wherein M is an integer larger than 1; and calculating an absolute value of a difference between the first backlight brightness eigenvalue and a second backlight brightness eigenvalue of one block of a previous frame, the backlight brightness variation of the frame and its previous frame and whether there are noises can be determined according to the absolute value. Specifically, the absolute value is compared with the backlight brightness variation threshold to further determine the time-averaged length T. When the absolute value is larger than or equal to the backlight brightness variation threshold, it can be determined that the backlight brightness variation between the frame and its previous frame is dramatic, and thus the time-averaged length T can be determined as 0. On the other hand, when the absolute value is smaller than the backlight brightness variation threshold, it can be determined that the backlight brightness variation between the frame and its previous frame is less, and thus the time-averaged length T can be determined as the predetermined frame length T0. The third backlight brightness eigenvalue is calculated according to the first backlight brightness eigenvalue and T backlight brightness eigenvalues of the T frames. The backlight of one block of the frame is driven according to the third backlight brightness eigenvalue. As a result, when the brightness of the backlight dramatically varies from one frame to the next frame, the brightness of the backlight can be quickly adjusted with the frames, and when the brightness of the backlight slightly varies from one frame to the next frame, the flickers caused by the brightness variation can be filtered.

Figure 3A:
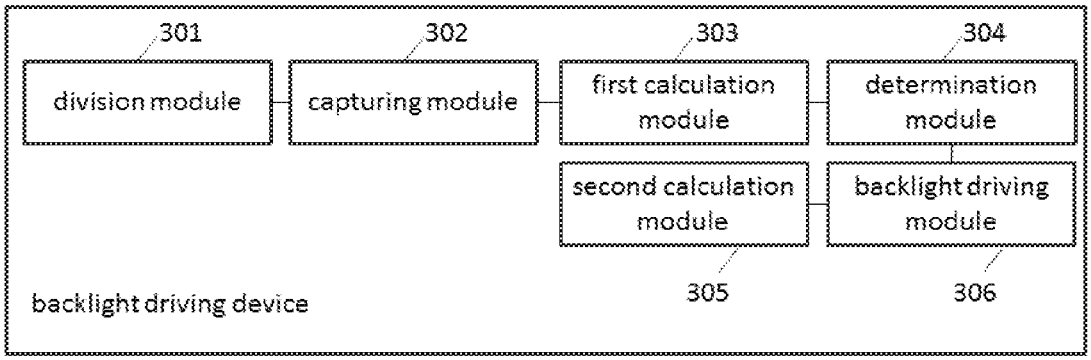
FIG. 3A is a structural schematic diagram of a backlight driving device according to one embodiment of the disclosure.

Referring to FIG. 3A, a structural schematic diagram of a backlight driving device according to one embodiment of the disclosure is shown. The backlight driving device includes a division module 301, a capturing module 302, a first calculation module 303, a determination module 304, a second calculation module 305 and a backlight driving module 306.

In this embodiment, the division module 301 divides one frame into N blocks, wherein N is a positive integer. The capturing module 302 obtains a first backlight brightness eigenvalue of one block of the frame, and obtains a backlight brightness eigenvalue of one block of each of M adjacent frames, wherein M is an integer larger than 1. The first calculation module 303 calculates an absolute value of a difference between the first backlight brightness eigenvalue and a second backlight brightness eigenvalue of one block of a previous frame. The determination module 304 determines a time-averaged length according to the absolute value. The time-averaged length corresponds to T adjacent frames and T is an integer larger than 1. The second calculation module 305 calculates a third backlight brightness eigenvalue of the one block of the frame according to the first backlight brightness eigenvalue and a backlight brightness eigenvalue of one block of each of the T adjacent frames. The backlight driving module 306 drives the backlight corresponding to the one block of the frame according to the third backlight brightness eigenvalue.

Figure 3B:
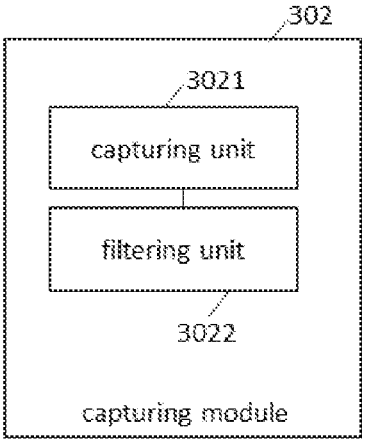
FIG. 3B is a structural schematic diagram of a capturing module of the backlight driving device shown in FIG. 3A according to one embodiment of the disclosure.

Referring to FIG. 3B, a structural schematic diagram of a capturing module of the backlight driving device shown in FIG. 3A according to one embodiment of the disclosure is shown. As shown in FIG. 3B, the capturing module 302 includes a capturing unit 3021 and a filtering unit 3022. The capturing unit 3021 obtains a fourth backlight brightness eigenvalue of the one block of the frame. The filtering unit 3022 spatially filters the one block of the frame to obtain the first backlight brightness eigenvalue according to the fourth backlight brightness eigenvalue.

Figure 3C:
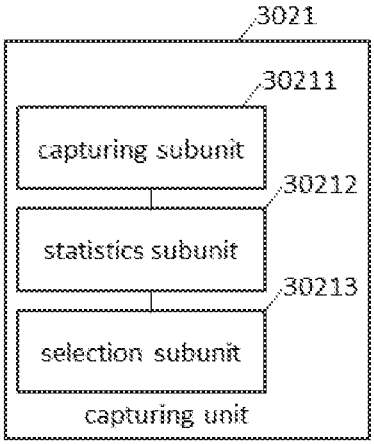
FIG. 3C is a structural schematic diagram of a capturing unit of the capturing module shown in FIG. 3B according to one embodiment of the disclosure.

Referring to FIG. 3C, a structural schematic diagram of a capturing unit of the capturing module shown in FIG. 3B according to one embodiment of the disclosure is shown. As shown in FIG. 3C, the capturing unit 3021 includes a capturing subunit 30211, a statistics subunit 30212 and a selection subunit 30213. The capturing subunit 30211 calculates a maximum gray-scale value of each of P pixels in the one block of the frame to obtain P gray-scale eigenvalues. Each maximum gray-scale value is one gray-scale eigenvalue and P is an integer larger than 1. The statistics subunit 30212 generates a statistical distribution table according to the P gray-scale eigenvalues. The selection subunit 30213 chooses a target gray-scale eigenvalue among the gray-scale eigenvalues as the fourth backlight brightness eigenvalue. The number of the chosen gray-scale eigenvalue is larger than a predetermined number.

Figure 3D:
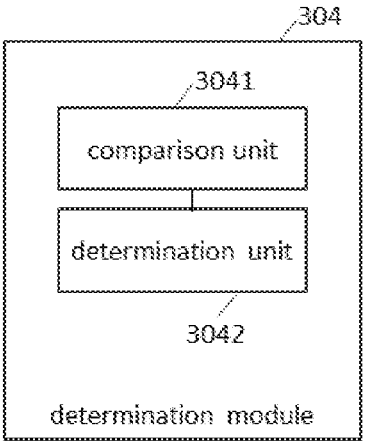
FIG. 3D is a structural schematic diagram of a determination module of the backlight driving device shown in FIG. 3A according to one embodiment of the disclosure.

Referring to FIG. 3D, a structural schematic diagram of a determination module of the backlight driving device shown in FIG. 3A according to one embodiment of the disclosure is shown. As shown in FIG. 3D, the determination module 304 includes a comparison unit 3041 and a determination unit 3042. The comparison unit 3041 compares the absolute value and a predetermined backlight brightness variation threshold. The determination unit 3042 determines the time-averaged length as a predetermined frame length when the absolute value is smaller than the predetermined backlight brightness variation threshold, but determines the time-averaged length as 0 when the absolute value is larger than or equal to the predetermined backlight brightness variation threshold, wherein 0<the predetermined frame length≤M.

The backlight driving module 306 calculates an average of the (T+1) backlight brightness eigenvalues including the first backlight brightness eigenvalue and the T backlight brightness eigenvalues. The average is the third backlight brightness eigenvalue of the one block of the frame.

According to the above, after executing the steps including: dividing one frame into N blocks, wherein N is a positive integer; obtaining a first backlight brightness eigenvalue of one block of the frame, and obtaining a backlight brightness eigenvalue of one block of each of M adjacent frames, wherein M is an integer larger than 1; and calculating an absolute value of a difference between the first backlight brightness eigenvalue and a second backlight brightness eigenvalue of one block of a previous frame, the backlight brightness variation of the frame and its previous frame and whether there are noises can be determined according to the absolute value. For example, when the absolute value is not smaller than the backlight brightness variation threshold, it can be determined that the backlight brightness variation between the frame and its previous frame is dramatic. On the other hand, when the absolute value is smaller than the backlight brightness variation threshold, it can be determined that the backlight brightness variation between the frame and its previous frame is less. The time-averaged length T is determined according to the absolute value, and the time-averaged length T corresponds to T frames adjacent to the frame. The third backlight brightness eigenvalue is calculated according to the first backlight brightness eigenvalue and T backlight brightness eigenvalues of the T frames. The backlight of one block of the frame is driven according to the third backlight brightness eigenvalue. As a result, when the brightness of the backlight dramatically varies from one frame to the next frame, the brightness of the backlight can be quickly adjusted with the frames, and when the brightness of the backlight slightly varies from one frame to the next frame, the flickers caused by the brightness variation can be filtered.

Figure 4:
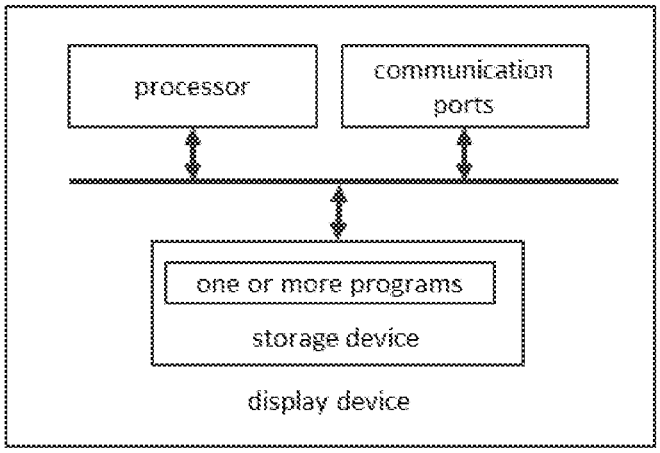
FIG. 4 is a structural schematic diagram of a display device according to one embodiment of the disclosure.

Referring to FIG. 4, a structural schematic diagram of a display device according to one embodiment of the disclosure is shown. As shown in FIG. 4, the display device includes at least one processor, at least one storage device, at least one communication port and one or more programs. The one or more programs are stored in the storage device and executed by one or more processors. The backlight driving method described above is implemented by the one or more programs, and the one or more programs includes instructions as follows: dividing one frame into N blocks, wherein N is a positive integer, obtaining a first backlight brightness eigenvalue of one block of the frame, and obtaining a backlight brightness eigenvalue of one block of each of M adjacent frames, wherein M is an integer larger than 1; calculating an absolute value of a difference between the first backlight brightness eigenvalue and a second backlight brightness eigenvalue of one block of a previous frame; determining a time-averaged length according to the absolute value, wherein the time-averaged length corresponds to T adjacent frames and T is an integer larger than 1; calculating a third backlight brightness eigenvalue of the one block of the frame according to the first backlight brightness eigenvalue and a backlight brightness eigenvalue of one block of each of the T adjacent frames; and driving the backlight corresponding to the one block of the frame according to the third backlight brightness eigenvalue.

In other embodiments, the one or more programs further includes instructions as follows: obtaining a fourth backlight brightness eigenvalue of the one block of the frame; and spatially filtering the one block of the frame to obtain the first backlight brightness eigenvalue according to the fourth backlight brightness eigenvalue.

In other embodiments, the one or more programs further includes instructions as follows: calculating a maximum gray-scale value of each of P pixels in the one block of the frame to obtain P gray-scale eigenvalues, wherein each maximum gray-scale value is one gray-scale eigenvalue and P is an integer larger than 1; generating a statistical distribution table according to the P gray-scale eigenvalues; and choosing a target gray-scale eigenvalue among the gray-scale eigenvalues as the fourth backlight brightness eigenvalue, wherein the number of the chosen gray-scale eigenvalue is larger than a predetermined number.

In other embodiments, the one or more programs further includes instructions as follows: comparing the absolute value and a predetermined backlight brightness variation threshold; and determining the time-averaged length as a predetermined frame length when the absolute value is smaller than the predetermined backlight brightness variation threshold, but determining the time-averaged length as 0 when the absolute value is larger than or equal to the predetermined backlight brightness variation threshold, wherein 0<the predetermined frame length≤M.

In other embodiments, the one or more programs further includes instructions as follows: calculating an average of the (T+1) backlight brightness eigenvalues including the first backlight brightness eigenvalue and the T backlight brightness eigenvalues, wherein the average is the third backlight brightness eigenvalue of the one block of the frame.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of the present invention.

Functions described above can be implemented by the methods provided in the above embodiments, and the methods provided in the above embodiments can be executed by different function modules. Each function module is assigned to execute one or more steps in the above methods.

Two or more than two function modules can be integrated into one processing unit. The function module and the processing unit can be implemented by hardware or the combination of hardware and software. The function modules described above are for illustrating but not for restricting the present disclosure. In other words, some of them can be divided into smaller function modules, and some of them can be combined together, and it is not limited thereto.

The computer readable medium provided by the present disclosure stores a computer program for data exchanging. A computer executes the computer program for implementing the backlight driving method described above.

The computer program product provided by the present disclosure includes a non-transitory computer readable storage medium storing a computer program. A computer executes the computer program for implementing the backlight driving method described above.

The steps of the methods in the above embodiments are for illustrating but not for restricting the present disclosure. Specifically, the sequence of and/or operations is not limited to that set forth herein and may be changed as is known in the art, with the exception of steps and/or operations necessarily occurring in a certain order. Also, descriptions of functions and constructions that are well known to one of ordinary skill in the art may be omitted for increased clarity and conciseness.

In the above descriptions, every embodiment has been illustrated. If there is any detail of certain embodiment not been mentioned, please refer to the relevant descriptions of other embodiments.

In the several embodiments provided in the present application, it should be understood that the disclosed system, apparatus, and method may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented through some interfaces. The indirect couplings or communication connections between the apparatuses or units may be implemented in electronic, mechanical, or other forms.

The embodiments of the mobile device described above are only schematic, a unit which may be described as a separated part may be or not physically separated, a member for unit display may be or not a physical unit, that is the member may be located at one place or distributed to multiple network units. A part of or all modules may be selected to achieve the purposes of the schemes of the embodiments according to practical demands. The present disclosure may be understood and implemented by common technicians of the field without creative work.

In addition, in the present disclosure, function modules can be integrated into one processing unit or not. Two or more function modules can be integrated into one function module. The integrated function modules can be implemented by hardware or the combination of hardware and software.

If the integrated function modules are implemented by software and thus become an independent product for sell or use, it can be stored in a computer readable storage device. Based on the understanding, the technical scheme or the contribution to the prior art may be fundamentally reflected in a software product mode, and a computer software product may be stored in a computer readable storage medium such as an ROM/RAM, a disc and a compact disc, and includes a plurality of instructions for enabling computer equipment (such as a personal computer, a server or network equipment) to execute embodiments or methods described in parts of the embodiments.

Further, those skilled in the art may understand that all or part of the steps of the methods in the above embodiments may be relevant hardware instructed by programs. The programs may be stored in a computer readable storage device, such as a ROM/RAM, magnetic disk, or optical disk.

The foregoing contents are detailed description of the disclosure in conjunction with specific preferred embodiments and concrete embodiments of the disclosure are not limited to these description. For the person skilled in the art of the disclosure, without departing from the concept of the disclosure, simple deductions or substitutions can be made and should be included in the protection scope of the application.

What is claimed is:

1. A backlight driving method, comprising:

dividing one frame into N blocks in spatial, wherein N is a positive integer;

obtaining a first backlight brightness eigenvalue of one block of the frame, and obtaining a backlight brightness eigenvalue of one block of each of M adjacent frames, wherein M is an integer larger than 1;

calculating an absolute value of a difference between the first backlight brightness eigenvalue and a second backlight brightness eigenvalue of one block of a previous frame;

determining a time-averaged length according to the absolute value, wherein the time-averaged length corresponds to T adjacent frames and T is an integer larger than 1;

calculating a third backlight brightness eigenvalue of the one block of the frame according to the first backlight brightness eigenvalue and a backlight brightness eigenvalue of one block of each of the T adjacent frames; and driving the backlight corresponding to the one block of the frame according to the third backlight brightness eigenvalue, wherein obtaining the first backlight brightness eigenvalue of the one block of the frame comprises:

obtaining a fourth backlight brightness eigenvalue of the one block of the frame; and spatially filtering the one block of the frame to obtain the first backlight brightness eigenvalue according to the fourth backlight brightness eigenvalue;

wherein obtaining the fourth backlight brightness eigenvalue of the one block of the frame comprises:

calculating a maximum gray-scale value of each of P pixels in the one block of the frame to obtain P gray-scale eigenvalues, wherein each maximum gray-scale value is one gray-scale eigenvalue and P is an integer larger than 1;

generating a statistical distribution table according to the P gray-scale eigenvalues; and choosing a target gray-scale eigenvalue among the gray-scale eigenvalues as the fourth backlight brightness eigenvalue, wherein the number of the chosen gray-scale eigenvalue is larger than a predetermined number;

wherein determining the time-averaged length according to the absolute value comprises:

comparing the absolute value and a predetermined backlight brightness variation threshold; and determining the time-averaged length as a predetermined frame length when the absolute value is smaller than the predetermined backlight brightness variation threshold, but determining the time-averaged length as 0 when the absolute value is larger than or equal to the predetermined backlight brightness variation threshold, wherein 0<the predetermined frame length≤M;

wherein calculating the third backlight brightness eigenvalue of the one block of the frame according to the first backlight brightness eigenvalue and the backlight brightness eigenvalue of the one block of each of the T adjacent frames includes:

calculating an average of the (T+1) backlight brightness eigenvalues including the first backlight brightness eigenvalue and the T backlight brightness eigenvalues;

wherein the average is the third backlight brightness eigenvalue of the one block of the frame.

2. A backlight driving device, comprising:

a division module, dividing one frame into N blocks, wherein N is a positive integer;

a capturing module, obtaining a first backlight brightness eigenvalue of one block of the frame, and obtaining a backlight brightness eigenvalue of one block of each of M adjacent frames, wherein M is an integer larger than 1;

a first calculation module, calculating an absolute value of a difference between the first backlight brightness eigenvalue and a second backlight brightness eigenvalue of one block of a previous frame;

a determination module, determining a time-averaged length according to the absolute value, wherein the time-averaged length corresponds to T adjacent frames and T is an integer larger than 1;

a second calculation module, calculating a third backlight brightness eigenvalue of the one block of the frame according to the first backlight brightness eigenvalue and a backlight brightness eigenvalue of one block of each of the T adjacent frames; and a backlight driving module, driving the backlight corresponding to the one block of the frame according to the third backlight brightness eigenvalue, wherein the capturing module comprises:

a capturing unit, obtaining a fourth backlight brightness eigenvalue of the one block of the frame; and a filtering unit, spatially filtering the one block of the frame to obtain the first backlight brightness eigenvalue according to the fourth backlight brightness eigenvalue;

wherein the capturing unit comprises:

a capturing subunit, calculating a maximum gray-scale value of each of P pixels in the one block of the frame to obtain P gray-scale eigenvalues, wherein each maximum gray-scale value is one gray-scale eigenvalue and P is an integer larger than 1;

a statistics subunit, generating a statistical distribution table according to the P gray-scale eigenvalues; and a selection subunit, choosing a target gray-scale eigenvalue among the gray-scale eigenvalues as the fourth backlight brightness eigenvalue, wherein the number of the chosen gray-scale eigenvalue is larger than a predetermined number;

wherein the determination module comprises:

a comparison unit, comparing the absolute value and a predetermined backlight brightness variation threshold; and a determination unit, determining the time-averaged length as a predetermined frame length when the absolute value is smaller than the predetermined backlight brightness variation threshold, but determining the time-averaged length as 0 when the absolute value is larger than or equal to the predetermined backlight brightness variation threshold, wherein 0<the predetermined frame length≤M;

wherein the backlight driving module is configured to calculate an average of the (T+1) backlight brightness eigenvalues including the first backlight brightness eigenvalue and the T backlight brightness eigenvalues;

wherein the average is the third backlight brightness eigenvalue of the one block of the frame.

* * * * *